US009038207B2

(12) United States Patent
Cheerla et al.

(10) Patent No.: US 9,038,207 B2
(45) Date of Patent: May 26, 2015

(54) TOILET OVERFILL REGULATOR

(75) Inventors: Mahesh Cheerla, Howell, MI (US); Timothy David Mulligan, Saline, MI (US); Mordechai Lev, West Bloomfield, MI (US)

(73) Assignee: Brass Craft Manufacturing Company, Novi, MI (US)

( * ) Notice: Subject to any disclaimer, the term of this patent is extended or adjusted under 35 U.S.C. 154(b) by 642 days.

(21) Appl. No.: 13/347,916

(22) Filed: Jan. 11, 2012

(65) Prior Publication Data

US 2012/0174308 A1 Jul. 12, 2012

Related U.S. Application Data

(60) Provisional application No. 61/431,992, filed on Jan. 12, 2011.

(51) Int. Cl.
*E03D 11/00* (2006.01)
*E03D 1/30* (2006.01)

(52) U.S. Cl.
CPC . *E03D 11/00* (2013.01); *E03D 1/30* (2013.01)

(58) Field of Classification Search
CPC ..... E03D 1/14
USPC ..... 4/300–442
See application file for complete search history.

(56) References Cited

U.S. PATENT DOCUMENTS

| | | | | |
|---|---|---|---|---|
| 1,331,018 | A * | 2/1920 | Luthy | 429/143 |
| 1,503,265 | A * | 7/1924 | Goldman | 152/179 |
| 3,086,546 | A * | 4/1963 | Brown | 137/436 |
| 3,902,201 | A * | 9/1975 | Bobo | 251/59 |
| 4,145,775 | A * | 3/1979 | Butler | 4/415 |
| 4,637,426 | A * | 1/1987 | Lyon | 137/433 |
| 4,980,932 | A * | 1/1991 | Stemples | 4/415 |
| 5,134,729 | A * | 8/1992 | Shaw | 4/415 |
| 5,287,565 | A * | 2/1994 | Auman et al. | 4/415 |
| 5,708,991 | A * | 1/1998 | DeMarco | 4/415 |
| 5,715,860 | A * | 2/1998 | Horad | 137/441 |
| 6,385,788 | B1 * | 5/2002 | Wasielewski | 4/415 |
| 6,823,889 | B1 * | 11/2004 | Schuster | 137/441 |
| 7,047,574 | B2 * | 5/2006 | Patterson | 4/324 |
| 7,376,984 | B2 * | 5/2008 | Molter | 4/415 |
| 2006/0168716 | A1 * | 8/2006 | Schuster et al. | 4/415 |
| 2006/0168717 | A1 * | 8/2006 | Schuster et al. | 4/415 |
| 2006/0272704 | A1 * | 12/2006 | Fima | 137/12 |
| 2006/0272830 | A1 * | 12/2006 | Fima | 169/16 |

FOREIGN PATENT DOCUMENTS

WO 2006/083507 A2 8/2006

* cited by examiner

*Primary Examiner* — Lori Baker
(74) *Attorney, Agent, or Firm* — Carlson, Gaskey & Olds, PC

(57) ABSTRACT

A kit for calibrating an amount of water required by a toilet with an amount of water to be supplied to the toilet has a first recorder for determining an amount of water in a toilet bowl, a second recorder for determining an amount of water in a toilet tank if the water in the toilet bowl reaches a determined level, and a valve for setting an amount of water delivered to the tank if the water reaches a determined level in the tank.

20 Claims, 2 Drawing Sheets

TOILET OVERFILL REGULATOR

CROSS REFERENCE TO RELATED APPLICATION

This application claims priority to U.S. Provisional Application No. 61/431,992, filed on Jan. 12, 2011.

FIELD OF THE INVENTION

This invention relates to overfill water saving valves and more particularly to overfill water saving valves for toilets.

BACKGROUND

Given water shortages in various regions of United States and the rest of the world, water conservation is becoming a high priority for people and local governments. Toilets consume roughly 28% of the water used on a daily basis in the United States. It is a continuing priority to save water used by toilets.

SUMMARY

According to an exemplary embodiment, a kit for calibrating an amount of water required by a toilet with an amount of water to be supplied to the toilet has a first recorder for determining an amount of water in a toilet bowl, a second recorder for determining an amount of water in a toilet tank if the water in the toilet bowl reaches a determined level, and a valve for setting an amount of water delivered to the tank if the water reaches a determined level in the tank.

According to a further exemplary method for setting an amount of water in a toilet tank includes determining an amount of water in a toilet bowl, determining an amount of water in a toilet tank if the water in the toilet bowl reaches a determined level and regulating an amount of water delivered to the tank if the water reaches a determined level in the tank.

These and other features of the present invention can be best understood from the following specification and drawings, the following of which is a brief description.

DETAILED DESCRIPTION OF THE PREFERRED EMBODIMENT

Figure 1:
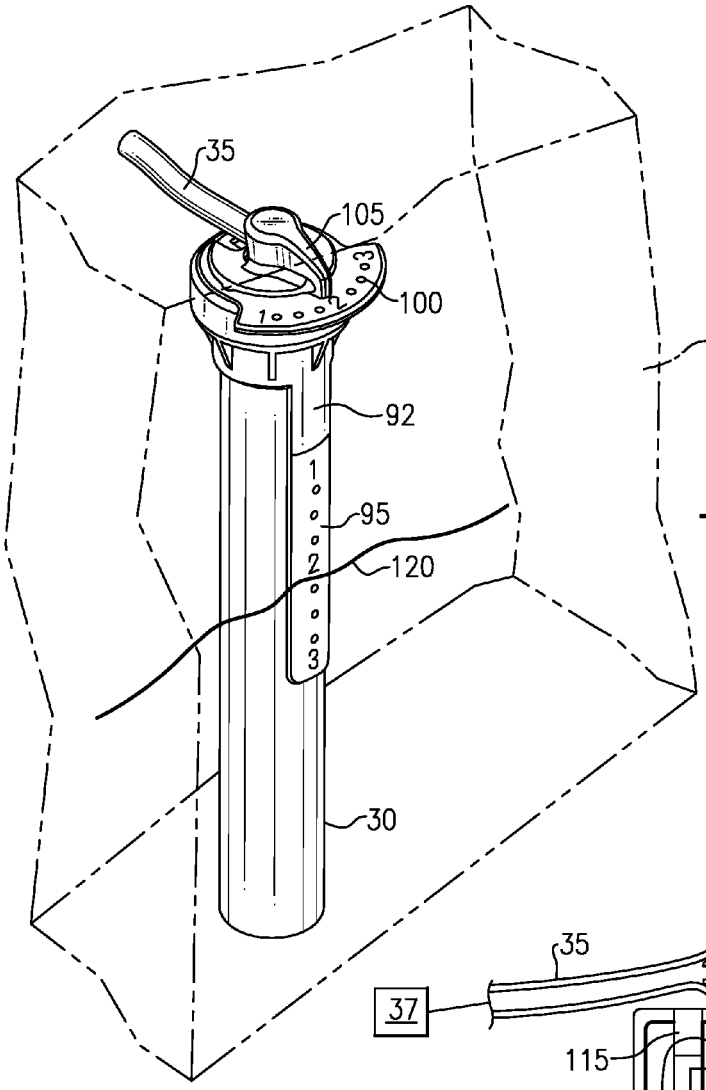
FIG. 1 shows a schematic embodiment of a overfill tube engage used in a toilet tank.
Figure 2:
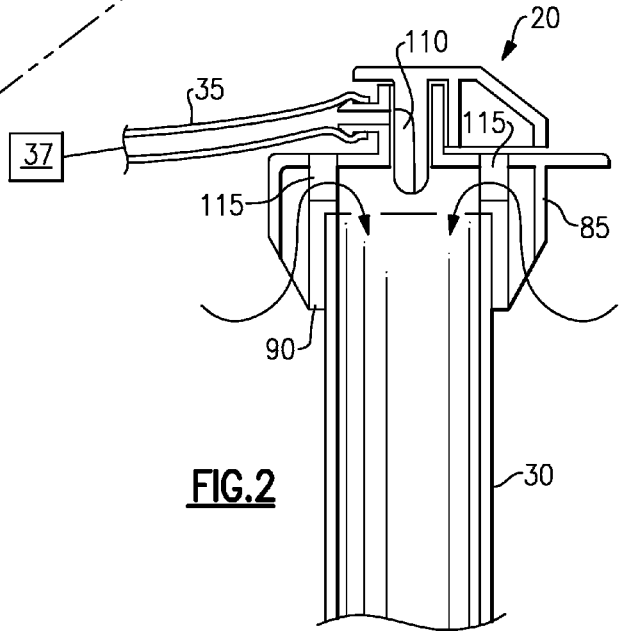
FIG. 2 is a schematic view of the overfill tube of FIG. 1.
Figure 3:
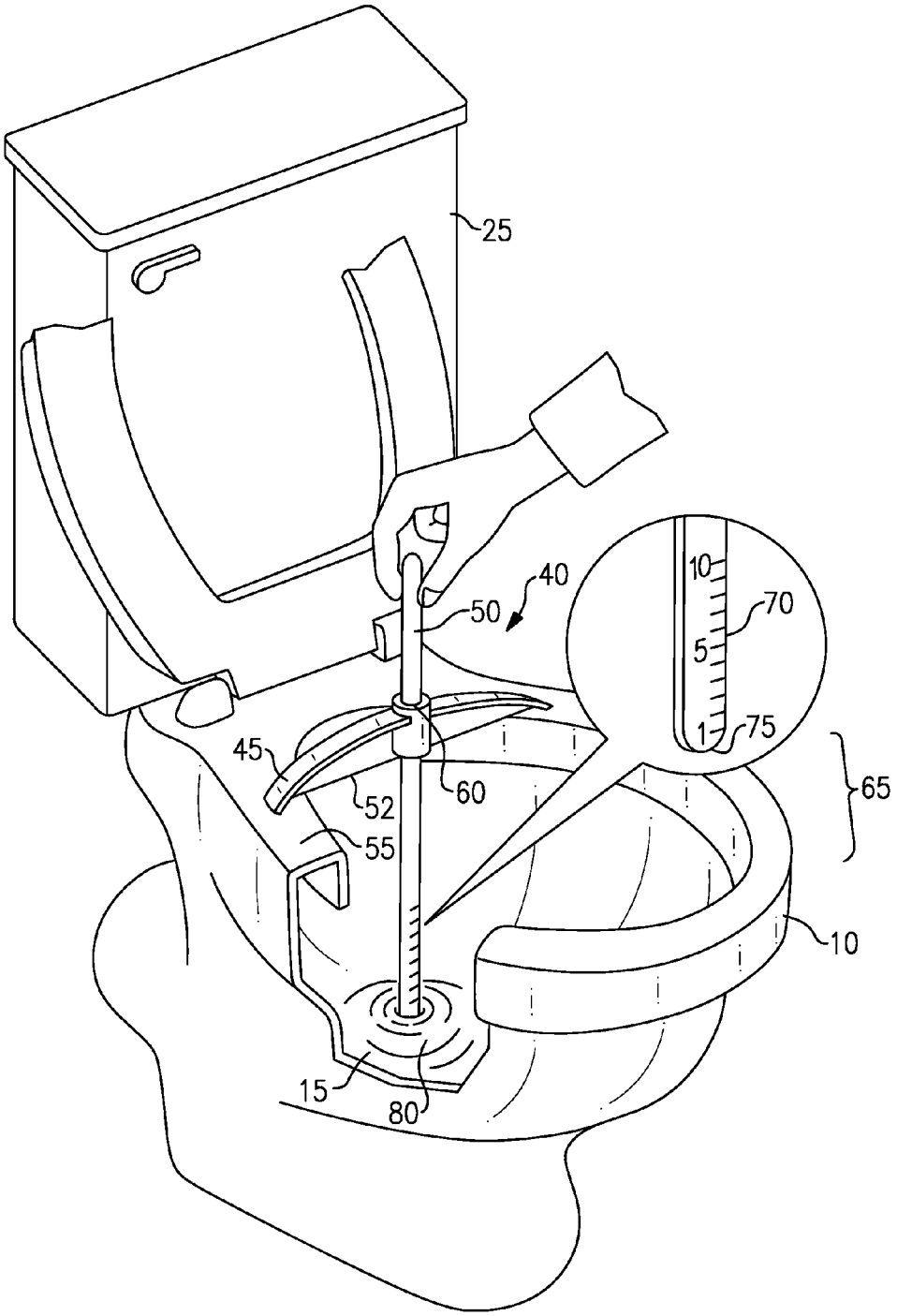
FIG. 3 is a schematic view of a partially cut away toilet in which a water level of the toilet bowl is calibrated.

Referring to FIGS. 1-3, a kit for calibrating and limiting the overflow from a toilet bowl 10 is shown. The kit allows a user to correlate a water depth 15 of the toilet bowl 10 with the height of an overfill regulator 20 to minimize excessive or leakage flow from a toilet bowl tank 25.

The kit is comprised of a overfill tube 30 that connects to a conduit 35 from an existing fill valve 37, a user's gauge 40 (see FIG. 3) that has a bridge 45 and a calibration pole 50, and the overfill regulator 20 (See FIGS. 1 and 2).

The bridge 45 as shown in FIG. 3, includes has a horizontal portion 52 that is designed to rest on the rim 55 of the toilet bowl 10, and an opening 60 that is perpendicular to a plane 65 of the rim 55. The calibration pole 50, which has a calibrating scale 70 disposed at an end 75 that is disposed within the water 80 within the toilet bowl, extends through the opening 60 in the user's gauge 40.

The overfill regulator 20 comprises a cylindrical body 85 having an opening 90 for sitting on the overfill tube 30, a downwardly extending flange 92 having a calibration scale 95 disposed thereon, a dial setting 100, and a dial 105. The dial 105 is attached to a regulator 110 that regulates the amount of water flowing through the conduit into the overfill tube 30 as the dial 105 is rotated. Overflow openings 115 set the level of permissible overflow through the system.

In operation, the overfill tube 30 is placed in the toilet tank 25 or for a retrofit, replaces an existing overfill tube (not shown) in the toilet tank 25. The overfill regulator 20 is placed over the overfill tube 30 and connected to the conduit 35 from an existing fill valve (not shown). The user then assembles the user's gauge 40 and locates it on the toilet rim 55 such that the pole 50 extends through the opening 60 of the bridge 45. The pole 50 is lowered until the scale 70 is in the water 80 and the pole is bottomed out in the toilet bowl 10. The number on the scale indicating the toilet water level 15 is recorded.

The dial 105 on the dial setting 100 is set to the number "2". The toilet 10 is then flushed and the water level 120 rising in the tank is observed. One then records the water level on the scale 95 in the tank 25 at the moment that the water level in the toilet reaches the toilet's water level 15 as recorded earlier. The number on the scale 95 at this point in time is defined as the "water savings level". The dial is then set to the same number as the water savings level so that the tank will no longer fill beyond this level. At this point, the overfill regulator 20 is calibrated to the performance of this specific system which is installed on this saving maximum water. At this point in the system, the water level valve will allow no more water to flow into the tank. Water savings are achieved thereby.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from the essence of this disclosure. The scope of legal protection given to this disclosure can only be determined by studying the following claims.

What is claimed is:

1. A kit for calibrating an amount of water required by a toilet with an amount of water to be supplied to said toilet, said kit comprising:

a first recorder to determine an amount of water in a toilet bowl;

a second recorder to determine an amount of water in a toilet tank if said water in said toilet bowl reaches a determined level; and a regulator to regulate an amount of water delivered to an overfill tube if said water reaches a determined level in said tank.

2. A method for setting an amount of water in a toilet tank comprising the steps of:

using a first recorder to determine an amount of water in a toilet bowl;

using a second recorder to determine an amount of water in a toilet tank if said water in said toilet bowl reaches a determined level; and regulating an amount of water delivered to an overflow tube if said water reaches a determined level in said tank.

3. The method according to claim 2 wherein the first recorder comprises a user gauge including a bridge and a calibration pole with a calibrating scale disposed at an end of the calibration pole, and including disposing the end of the calibration pole within the water of the toilet bowl, and determining the amount of water in the toilet bowl prior to a flushing event.

4. The method according to claim 3 wherein the second recorder comprises a cylindrical body having an opening and a dial supported by the cylindrical body, the dial having a calibration scale disposed thereon, and including associating the opening of the cylindrical body with the overfill tube, setting the dial to an initial dial setting, flushing the toilet, recording a water level number of an amount of water in the toilet tank on the calibration scale at the moment the water in the toilet bowl reaches the amount previously recorded using the first recorder, and setting the dial to a calibrated setting that corresponds to the water level number.

5. The method according to claim 4 wherein the water level number recorded using the second recorder comprises a water savings level, and wherein once the dial is set to the calibrated setting, a regulator regulates the amount of water flowing from a supply conduit into the overfill tube such that water is prevented from flowing into the overflow tube once the water savings level is reached.

6. The method according to claim 2 including disconnecting a supply conduit from the overflow tube, installing the second recorder on the overflow tube, and connecting the supply conduit to the second recorder.

7. The method according to claim 6 including connecting the supply conduit to a fill valve.

8. The method according to claim 2 including manually operating the first recorder.

9. The method according to claim 2 including manually operating the second recorder.

10. The kit according to claim 1 wherein the first recorder comprises a user gauge including a bridge and a calibration pole with a calibrating scale disposed at an end of the calibration pole, and wherein the end of the calibration pole is disposed within the water of the toilet bowl, and wherein the amount of water in the toilet bowl is determined prior to a flushing event.

11. The kit according to claim 10 wherein the second recorder comprises a cylindrical body having an opening associated with the overfill tube and a dial supported by the cylindrical body, the dial having a calibration scale disposed thereon, and wherein the dial is set to an initial dial setting, and wherein, during a subsequent flushing event, a water level number of an amount of water in the toilet tank on the calibration scale is recorded at the moment the water in the toilet bowl reaches the amount previously recorded using the first recorder, and wherein the dial is subsequently set to a calibrated setting that corresponds to the water level number.

12. The kit according to claim 11 wherein the water level number recorded using the second recorder comprises a water savings level, and wherein once the dial is set to the calibrated setting, the regulator regulates the amount of water flowing from a supply conduit into the overfill tube such that water is prevented from flowing into the overflow tube once the water savings level is reached.

13. The kit according to claim 10 wherein the bridge has a horizontal portion that is configured to rest on a rim of the toilet bowl, and wherein the horizontal portion includes an opening that receives the calibration pole.

14. The kit according to claim 1 wherein the second recorder is connected to the overflow tube.

15. The kit according to claim 14 including a supply conduit connected to the second recorder, the supply conduit being connected to a fill valve.

16. The kit according to claim 14 wherein the second recorder is manually adjustable.

17. The kit according to claim 1 wherein the first recorder is manually operated.

18. A kit for calibrating an amount of water required by a toilet with an amount of water to be supplied to said toilet, said kit comprising:

a gauge to selectively measure an amount of water in a toilet bowl; and an overfill regulator to limit overflow from the toilet bowl, the overfill regulator comprising a cylindrical body having an opening to be associated with an overfill tube, a dial supported by the cylindrical body and being selectively adjustable to a calibrated setting that is determined based on the amount of water in the toilet bowl measured by the gauge, and a regulator to regulate an amount of water delivered to the overfill tube if the water reaches a determined level in the tank that corresponds to the amount of water in the toilet bowl.

19. The kit according to claim 18 wherein the user gauge includes a bridge and a calibration pole with a calibrating scale disposed at an end of the calibration pole, and wherein the end of the calibration pole is selectively disposed within the water of the toilet bowl, and wherein the amount of water in the toilet bowl is determined via the calibrating scale prior to a flushing event, and wherein the dial has a calibration scale disposed thereon, and wherein the dial is set to an initial dial setting, and wherein, during a subsequent flushing event, a water level number of an amount of water in the toilet tank on the calibration scale is recorded at the moment the water in the toilet bowl reaches the amount previously recorded using the gauge, and wherein the dial is subsequently set to a calibrated setting that corresponds to the water level number.

20. The kit according to claim 19 wherein the water level number recorded using the calibration scale comprises a water savings level, and wherein once the dial is set to the calibrated setting, the regulator regulates the amount of water flowing from a supply conduit into the overfill tube such that water is prevented from flowing into the overflow tube once the water savings level is reached.

* * * * *